US010106386B2

(12) United States Patent
Ueda et al.

(10) Patent No.: US 10,106,386 B2
(45) Date of Patent: Oct. 23, 2018

(54) HYDRAULIC CONTROL DEVICE OF A FORKLIFT TRUCK

(71) Applicant: KABUSHIKI KAISHA TOYOTA JIDOSHOKKI, Kariya-shi, Aichi-ken (JP)

(72) Inventors: Yuki Ueda, Aichi-ken (JP); Naoya Yokomachi, Aichi-ken (JP); Tsutomu Matsuo, Aichi-ken (JP); Takashi Uno, Aichi-ken (JP); Tetsuya Goto, Aichi-ken (JP); Takanori Kanna, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 146 days.

(21) Appl. No.: 15/152,012

(22) Filed: May 11, 2016

(65) Prior Publication Data

US 2016/0332854 A1 Nov. 17, 2016

(30) Foreign Application Priority Data

May 14, 2015 (JP) ..... 2015-099226

(51) Int. Cl.
*B66F 9/20* (2006.01)
*B66F 9/22* (2006.01)
(Continued)

(52) U.S. Cl.
CPC ..... *B66F 9/22* (2013.01); *B66F 9/205* (2013.01); *F15B 11/161* (2013.01);
(Continued)

(58) Field of Classification Search
CPC ..... E02F 9/2282; B66F 9/22; B66F 9/205; F15B 13/06; F15B 11/161; F15B 13/021
See application file for complete search history.

(56) References Cited

U.S. PATENT DOCUMENTS 9,631,613 B2 * 4/2017 Ueda ..... F04B 35/045
9,771,250 B2 * 9/2017 Ueda ..... B66F 9/22

FOREIGN PATENT DOCUMENTS

EP 2818446 A1 12/2014
JP 02-231398 A 9/1990
JP 2013133196 A 7/2013

OTHER PUBLICATIONS

Communication dated Oct. 20, 2016 from the European Patent Office in counterpart application No. 16168693.6.

* cited by examiner

*Primary Examiner* — Michael Leslie
*Assistant Examiner* — Abiy Teka
(74) *Attorney, Agent, or Firm* — Sughrue Mion, PLLC

(57) ABSTRACT

A hydraulic control device of a forklift truck includes a first hydraulic cylinder, a first instruction member, a second hydraulic cylinder, a second instruction member, a hydraulic pump, an electric motor, a first passage which has a drain passage, a lowering control valve that controls flow of hydraulic oil, a flow rate control valve, and a controller. When a lowering operation of forks and an operation of a hydraulically-operated unit are performed simultaneously, when a required rotation speed of the hydraulic pump that is required for operating the hydraulically-operated unit at an instruction speed based on an operation of the second instruction member is a specified rotation speed or lower, the controller controls an instruction rotation speed of the electric motor so as to operate the hydraulic pump at the required rotation speed to thereby restrict the operation of the hydraulic pump.

7 Claims, 5 Drawing Sheets

(51) Int. Cl.
*F15B 11/16* (2006.01)
*F15B 13/02* (2006.01)
*F15B 13/06* (2006.01)

(52) U.S. Cl.
CPC ..... *F15B 13/021* (2013.01); *F15B 13/06* (2013.01); *F15B 2211/20515* (2013.01); *F15B 2211/40576* (2013.01)

HYDRAULIC CONTROL DEVICE OF A FORKLIFT TRUCK

BACKGROUND OF THE INVENTION

The present invention relates to a hydraulic control device of a forklift truck.

A forklift truck generally uses a hydraulic cylinder as a mechanism for operating movable loading members of the forklift truck such as forks. For example, Japanese Unexamined Patent Application Publication No. H02-231398 discloses a hydraulic control device having a single hydraulic pump and a single electric motor that drives the hydraulic pump. The hydraulic pump is driven to rotate so as to operate hydraulic cylinders (lift cylinders) that lift and lower the forks and hydraulic cylinders (tilt cylinders) that tit the mast assembly of the forklift truck.

When a hydraulic control device which has a single hydraulic pump operates any selected one of a plurality of movable loading members, the hydraulic control device controls the operation of the hydraulic pump in accordance with a speed that is instructed for operating the selected loading member. However, when the hydraulic control device operates a plurality of movable loading members simultaneously, the hydraulic control device controls the operation of the hydraulic pump in accordance with a speed that is instructed for any specific one of the loading members, and it is difficult to operate the plural loading members at their respective instructed speeds.

The present invention, which has been made in view of the problem above, is directed to providing a hydraulic control device of a forklift truck that is capable of operating a plurality of loading members in a desired manner.

SUMMARY OF THE INVENTION

In accordance with an aspect of the present invention, there is provided a hydraulic control device of a forklift truck that includes a first hydraulic cylinder that lifts and lowers forks of the forklift truck, a first instruction member that instructs lifting and lowering operation of the forks, a second hydraulic cylinder that operates a hydraulically-operated unit other than the forks, a second instruction member that instructs operation of the hydraulically-operated unit, a hydraulic pump that supplies hydraulic oil to the first hydraulic cylinder and the second hydraulic cylinder, an electric motor that is connected to the hydraulic pump and causes the hydraulic pump to operate, a first passage through which the first hydraulic cylinder and an intake port of the hydraulic pump are connected to each other, a lowering control valve that is disposed in the first passage and allows flow of hydraulic oil from the first hydraulic cylinder toward the hydraulic pump while the forks are being lowered and that blocks the flow of hydraulic oil from the first hydraulic cylinder toward the hydraulic pump while the forks are being lifted or at a stop, the first passage having a drain passage that is branched from the first passage at a portion between the lowering control valve and the hydraulic pump, a flow rate control valve that is disposed in the drain passage and controls a flow rate of hydraulic oil, and a controller that controls the electric motor based on operation of the first instruction member and the second instruction member. In a case of a simultaneous operation mode in which a lowering operation of the forks and an operation of the hydraulically-operated unit are performed simultaneously, when a required rotation speed of the hydraulic pump that is required for operating the hydraulically-operated unit at an instruction speed based on the operation of the second instruction member is a specified rotation speed or lower, the controller controls an instruction rotation speed of the electric motor so as to operate the hydraulic pump at the required rotation speed, and when the required rotation speed of the hydraulic pump is higher than the specified rotation speed, the controller controls the instruction rotation speed of the electric motor so as to operate the hydraulic pump at the specified rotation speed to thereby restrict the operation of the hydraulic pump.

Other aspects and advantages of the invention will become apparent from the following description, taken in conjunction with the accompanying drawings, illustrating by way of example the principles of the invention.

DETAILED DESCRIPTION OF THE EMBODIMENTS

First Embodiment

A first embodiment of a hydraulic control device of a forklift truck will now be described with reference to FIGS. 1 to 4.

Figure 1:
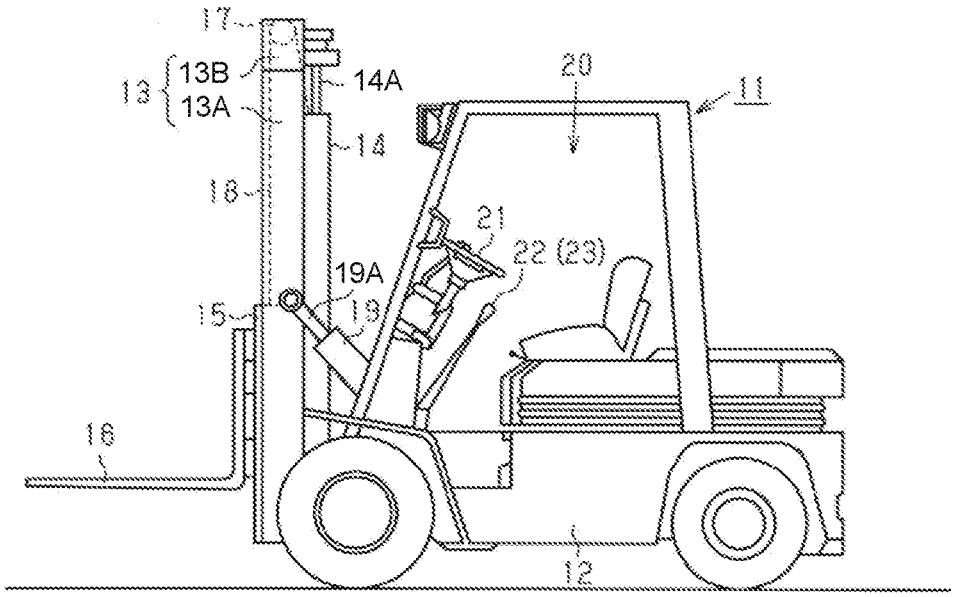
FIG. 1 is a side view of a forklift truck having a hydraulic control device according to an embodiment of the present invention.

Referring to FIG. 1, numeral 11 generally designates a forklift truck that includes a vehicle frame 12, and a mast assembly 13 that is mounted at a front of the vehicle frame 12. The mast assembly 13 includes a pair of right and left outer masts 13A (only one outer mast being shown in FIG. 1) and a pair of right and left inner masts 13B (only one inner mast being shown in FIG. 1) that are mounted inward of the outer masts 13A so as to be movable up and down relative to the vehicle frame 12. A lift cylinder 14 as the hydraulic mechanism is fixedly mounted in parallel relation to the rear side of each of the outer masts 13A. Each lift cylinder 14 has a piston rod 14A the end of which is coupled to an upper part of the inner mast 13B.

A lift bracket 15 is mounted inward of the inner masts 13B so as to be movable up and down along the inner masts 13B. A pair of forks 16 is mounted to the lift bracket 15. Each inner mast 13B supports at the top thereof a chain wheel 17 around which a chain 18 is mounted with one end thereof coupled to the lift cylinder 14 and the other end thereof coupled to the lift bracket 15. The extending and retracting motion of the lift cylinders 14 lifts and lowers the lift bracket 15 and hence the forks 16 via the chains 18. In the first embodiment, the lift cylinders 14 function as the first hydraulic cylinder of the present invention that lifts and lowers the forks 16.

The vehicle frame 12 has on the right and left sides thereof a pair of hydraulically-operated tilt cylinders 19 as the hydraulic mechanism. The tilt cylinders 19 are pivotably mounted at the base end thereof to the vehicle frame 12. Each tilt cylinder 19 has a piston rod 19A that is pivotably connected to the outer mast 13A in the middle in the vertical direction of the outer mast 13A. The extending and retracting motion of the tilt cylinders 19 causes the mast assembly 13 to tilt forward and rearward. Specifically, the extending and retracting motion of the tilt cylinders 19 causes the mast assembly 13 to tilt between a predetermined frontmost tilt position and a predetermined rearmost tilt position. With the upright position of the mast assembly 13 shown in FIG. 1 as the center, the movement of the mast assembly 13 tilting toward the operator's compartment 20 corresponds to the rearward tilting operation and the movement of the mast assembly 13 tilting away from the operator's compartment 20 corresponds to the frontward tilting operation, respectively. The forklift truck 11 according to the first embodiment is so configured that the mast assembly 13 is tilted forward and rearward by the extending and retracting operation of the tilt cylinders 19, respectively. According to the first embodiment, the tilt cylinders 19 function as the second hydraulic cylinder of the present invention that tilts the mast assembly 13, which is a hydraulically-operated unit provided separately from the forks. The titling operation of the mast assembly 13 corresponds to the second operation of the present invention that is performed independently of the operation of the forks 16.

The operator's compartment 20 includes a steering wheel 21, a lift control lever 22, and a tilt control lever 23. In the illustration of FIG. 1, the tilt control lever 23 is hidden by the lift control lever 22, so that the tilt control lever 23 is not shown in the drawing. The lift control lever 22 is operated to extend and retract the lift cylinders 14 to thereby lift and lower the forks 16. According to the first embodiment, the lift control lever 22 functions as the first instruction member of the present invention that instructs the lifting and lowering operation of the forks 16. The tilt control lever 23 is operated to extend and retract the tilt cylinders 19 to thereby tilt the mast assembly 13 forward and rearward. According to the first embodiment, the tilt control lever 23 functions as the tilting operation instruction member that instructs the tilting operation of the mast assembly 13. The tilt control lever 23 is an example of the second instruction member of the present invention that instructs the second operation that is performed independently of the operation of the forks 16.

In the case of the forklift truck 11 having a hydraulically-operated unit, a pair of unit hydraulic cylinders 25 as the hydraulic mechanism for operating the unit is provided to the forklift truck 11. An example of the unit includes one that causes the forks 16 to move right and left, tilt forward and rearward, or rotate. In such a case, the operator's compartment 20 is provided with a unit control lever 45 that instructs the motion of the unit. According to the first embodiment, the unit hydraulic cylinders 25 function as the second hydraulic cylinder of the present invention that operates the unit independently of the lift cylinders 14 for the forks 16. Further, according to the first embodiment, the unit control lever 45 functions as the unit operation instruction member that instructs the operation of the unit. The unit control lever 45 is an example of the second instruction member that instructs the second operation that is performed independently of the operation of the forks 16. The operation of the unit that is performed independently of the operation of the forks 16 corresponds to the second operation of the present invention.

Figure 3:
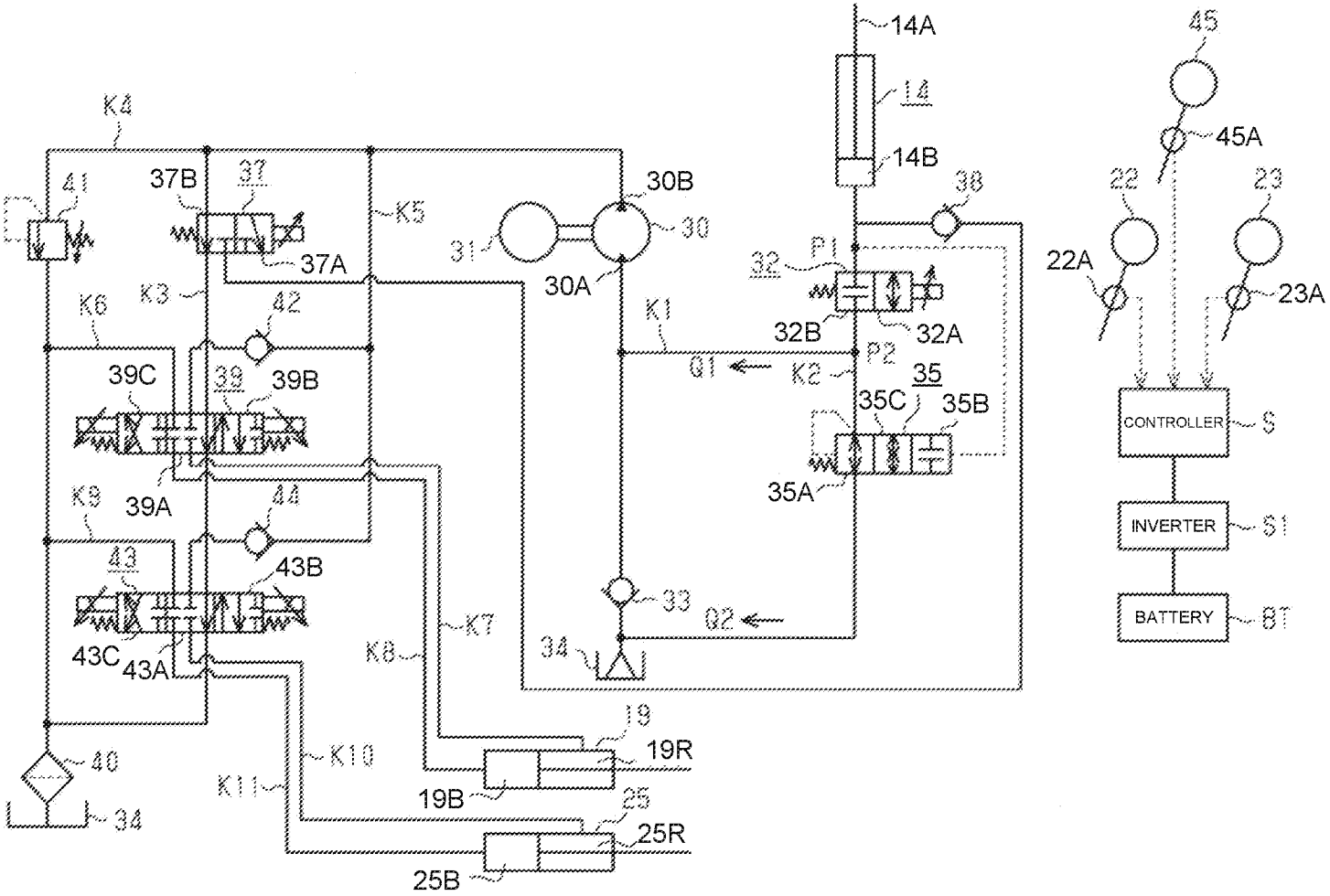
FIG. 3 is a circuit diagram of the hydraulic control device of the forklift truck of FIG. 1.

The hydraulic control device according to the first embodiment will now be described with reference to FIG. 3. The hydraulic control device of the first embodiment controls the operations of the lift cylinders 14, the tilt cylinders 19 and the unit hydraulic cylinders 25 for the loading unit. The hydraulic control device forms a hydraulic circuit that includes a plurality of hydraulic cylinders, a single electric motor and a single hydraulic pump that is connected to and driven by the electric motor to operate the hydraulic cylinders.

Each lift cylinder 14 has a bottom chamber 14B and a pipe K1 is connected at one end thereof to the bottom chamber 14B and at the other end thereof to a hydraulic pump motor 30 that functions as a hydraulic pump and a hydraulic motor. An electric motor (or an electric rotating machine) 31 that functions as an electric motor and a generator is connected to the hydraulic pump motor 30. According to the first embodiment, the electric motor 31 functions as an electric motor when the electric motor 31 drives the hydraulic pump motor 30 as a hydraulic pump, and functions as a generator when the electric motor 31 drives the hydraulic pump motor 30 as a hydraulic motor. The hydraulic pump motor 30 according to the first embodiment is rotatable in one direction.

A lowering proportional valve 32 is disposed in the pipe K1 between the lift cylinder 14 and the hydraulic pump motor 30. The lowering proportional valve 32 according to the first embodiment is a solenoid proportional valve. The lowering proportional valve 32 is switchable between a first position 32A as open and a second position 32B as closed. When the lowering proportional valve 32 is at the first position 32A or an open position, hydraulic oil that is discharged from the bottom chamber 14B in the lowering operation of the forks 16 is allowed to flow to the hydraulic pump motor 30. The opening of the lowering proportional valve 32 at the first position 32A is variable. When the lowering proportional valve 32 is at the second position 32B, that is, when the lowering proportional valve 32 is closed, the hydraulic oil is not allowed to flow. The lowering proportional valve 32 of the first embodiment corresponds to the lowering control valve of the present invention that allows flow of the hydraulic oil from the bottom chamber 14B of the lift cylinder 14 toward the hydraulic pump motor 30 when at the first position 32A and that blocks flow of the hydraulic oil from the bottom chamber 14B toward the hydraulic pump motor 30 when at the second position. The pipe K1 in which the lowering proportional valve 32 is disposed and which is connected between the lift cylinder 14 and the hydraulic pump motor 30 at an intake port 30A thereof corresponds to the lowering control valve of the present invention. The intake port 30A corresponds to the intake portion of the present invention. An oil tank 34 that stores therein hydraulic oil is connected to the intake port 30A of the hydraulic pump motor 30 through a check valve 33. The check valve 33 is configured to allow flow of the hydraulic oil from the oil tank 34 toward the hydraulic pump motor 30 but block flow of the hydraulic oil in the reverse direction thereof.

A pipe K2 is branched from the pipe K1 at a position between the lowering proportional valve 32 and the hydraulic pump motor 30 connected to the oil tank 34 on the downstream side of the lowering proportional valve 32. The pipe K2 corresponds to the drain passage (or the bypass passage) of the present invention. A flow rate control valve 35 is disposed in the pipe K2 and controls the flow rate of the hydraulic oil flowing in the pipe K2. The flow rate control valve 35 is switchable among a first position 35A as open, a second position 35B as closed, and a third position 35C also as open. The opening of the flow rate control valve 35 at the third position 35C is variable. The flow rate control valve 35 according to the first embodiment is configured to be switchable to any one of the first position 35A, the second position 35B, and the third position 35C according to a difference between a pressure P1 in the pipe between the lift cylinder 14 and the lowering proportional valve 32 and a pressure P2 in the pipe between the lowering proportional valve 32 and the hydraulic pump motor 30.

When the lowering proportional valve 32 is at the second position 32B and the lowering operation of the forks 16 is not performed, the pressure P1 is larger than the pressure P2. According to the pressure difference between the pressure P1 and the pressure P2, the flow rate control valve 35 is switched to the closed position (or the second position 35B). When the lowering proportional valve 32 is switched to the open position (or the first position 32A) to allow the hydraulic oil to flow therethrough, the pressure difference between the pressure P1 and the pressure P2 decreases to thereby switch the lowering proportional valve 32 to the open position (the third position 35C or the first position 35A). At this time, the opening of the flow rate control valve 35 is decreased as the pressure difference between the pressure P1 and the pressure P2 increases and is increased as the pressure difference between the pressure P1 and the pressure P2 decreases. Also, the hydraulic oil is allowed to flow toward the hydraulic pump motor 30 through the pipe K1 at a flow rate Q1 shown in FIG. 3, and the hydraulic oil is allowed to flow through the pipe K2 to return to the oil tank 34 (or the return side) at a flow rate that is determined according to the opening of the flow rate control valve 35. When the pressure difference between the pressure P1 and the pressure P2 increases at a later time with an increase of the rotation speed of the hydraulic pump motor 30, the flow rate control valve 35 is switched to the closed position again. At this time, the hydraulic oil is allowed to flow toward the hydraulic pump motor 30 only through the pipe K1 at the flow rate Q1 shown in FIG. 3. Specifically, when the flow rate control valve 35 is switched to the second position 35B, the hydraulic oil that is discharged from the bottom chamber 14B of the lift cylinder 14 is allowed to flow through the lowering proportional valve 32 into the hydraulic pump motor 30 through its intake port 30A. In this case, the whole of the hydraulic oil that has flowed through the lowering proportional valve 32 is flowed into the hydraulic pump motor 30 through the intake port 30A at the flow rate Q1. When the flow rate control valve 35 is switched to either the first position 35A or the third position 35C, on the other hand, the hydraulic oil that is discharged from the bottom chamber 14B of the lift cylinder 14 is allowed to flow through the lowering proportional valve 32 into the hydraulic pump motor 30 the intake port 30A and also to the oil tank 34. In this case, a part of the hydraulic oil that has flowed through the lowering proportional valve 32 is flowed to the hydraulic pump motor 30 through the intake port 30A at the flow rate Q1 shown in FIG. 3, and the remaining part of the hydraulic oil is flowed to the oil tank 34 at a flow rate Q2 shown in FIG. 3. The flow rate control valve 35 is configured to open at a desired opening in accordance with the pressure difference.

A lifting proportional valve 37 is connected to a portion of the pipe K1 that extends from a discharge port 30B of the hydraulic pump motor 30. The lifting proportional valve 37 is switchable between a first position 37A as open and a second position 37B as closed. When the lifting proportional valve 37 is at the first position 37A or an open position, hydraulic oil that is discharged from the hydraulic pump motor 30 is allowed to flow through a check valve 38 to the bottom chamber 14B of the lift cylinder 14. The opening of the lifting proportional valve 37 at the first position 37A is variable. When the lifting proportional valve 37 is at the second position 37B, that is, when the lifting proportional valve 37 is closed, the hydraulic oil is allowed to flow toward a tilting proportional valve 39 that is connected to a pipe K3. The check valve 38 is configured to allow the flow of the hydraulic oil that has passed through the lifting proportional valve 37 toward the bottom chamber 14B of the lift cylinder 14 but block the flow of the hydraulic oil in the reverse direction thereof, that is, from the bottom chamber 14B of the lift cylinder 14 toward the lifting proportional valve 37.

A pipe K4 is branched from the pipe K1 on the discharge port 30B side of the hydraulic pump motor 30 and connected to the oil tank 34 through a filter 40, and a pipe K5 is branched from the pipe K1 and connected to the tilting proportional valve 39. A relief valve 41 for preventing an excessive increase of pressure of the hydraulic oil is connected to the pipe K4. A pipe K6 is connected to the pipe K4 and allows the hydraulic oil that has passed through the tilting proportional valve 39 to flow toward the oil tank 34. A check valve 42 is provided in the pipe K5. The check valve 42 is configured to allow flow of the hydraulic oil from the hydraulic pump motor 30 toward the tilting proportional valve 39 but block flow of the hydraulic oil in the reverse direction thereof, that is, from the tilting proportional valve 39 to the hydraulic pump motor 30.

The tilting proportional valve 39 is switchable among a first position 39A as closed, a second position 39B as open, and a third position 39C as open. The opening of the tilting proportional valve 39 at the second and third positions 39B, 39C is variable. When the tilting proportional valve 39 is at the first position 39A, the hydraulic oil that has passed through the lifting proportional valve 37 in the pipe K3 is allowed to flow to the oil tank 34. The tilting proportional valve 39 according to the first embodiment is normally placed the first position 39A as the neutral position and switched to either the second position 39B or the third position 39C according to the control by a controller S. When the tilting proportional valve 39 is at the second position 39B, the hydraulic oil that has passed through the check valve 42 is allowed to flow through a pipe K7 that is connected to a rod chamber 19R of the tilt cylinder 19. Further, when the tilting proportional valve 39 is at the second position 39B, the hydraulic oil that is discharged from a bottom chamber 19B of the tilt cylinder 19 is allowed to flow through the pipe K6. When the tilting proportional valve 39 is at the third position 39C, the hydraulic oil that has passed through the check valve 42 is allowed to flow through a pipe K8 and the hydraulic oil that is discharged from the rod chamber 19R of the tilt cylinder 19 and flows through the pipe K7 is allowed to flow through the pipe K6.

A unit proportional valve 43 is connected in the pipe K3 between the tilting proportional valve 39 and the oil tank 34. A pipe K9 is connected the pipe K4 and allows flow of the hydraulic oil from the unit proportional valve 43 flows to the oil tank 34. The pipe K5 is connected to the unit proportional valve 43. A check valve 44 is provided in the pipe K5 and allows flow of the hydraulic oil from the hydraulic pump motor 30 toward the unit proportional valve 43 but blocks flow of the hydraulic oil from the unit proportional valve 43 toward the hydraulic pump motor 30.

The unit proportional valve 43 is switchable among a first position 43A as closed, a second position 43B as open, and a third position 43C as open. The opening of the unit proportional valve 43 at the second and third positions 43B, 43C is variable. When the unit proportional valve 43 is at the first position 43A, the hydraulic oil that has passed through the tilting proportional valve 39 through the pipe K3 is allowed to flow to the oil tank 34. The unit proportional valve 43 according to the first embodiment is normally placed in the first position 43A as the neutral position and switched to either the second position 43B or the third position 43C according to the control by the controller S. When the unit proportional valve 43 is at the second position 43B, the hydraulic oil that has passed through the check valve 44 is allowed to flow through a pipe K10 that is connected to a rod chamber 25R of the unit hydraulic cylinder 25 for unit. When the unit proportional valve 43 is at the second position 43B, the hydraulic oil that is discharged from a bottom chamber 25B of the unit hydraulic cylinder 25 and flows through a pipe K11 is allowed to flow through the pipe K9. When the unit proportional valve 43 is at the third position 43C, the hydraulic oil that has passed through the check valve 44 is allowed to flow through the pipe K11 and the hydraulic oil that is discharged from the rod chamber 25R of the unit hydraulic cylinder 25 is allowed to flow in the pipe K10 is allowed to flow through the pipe K9.

The controller S of the hydraulic control device will now be described with reference to FIG. 3.

The controller S includes a potentiometer 22A that detects the operation amount of the lift control lever 22, a potentiometer 23A that detects the operation amount of the tilt control lever 23, and a potentiometer 45A that detects the operation amount of the unit control lever 45 that are all electrically connected to the controller S. The controller S controls the rotation of the electric motor 31 and the switching of the lowering proportional valve 32 and the lifting proportional valve 37, in response to detection signal from the potentiometer 22A based on the detected operation amount of the lift control lever 22. The controller S controls the rotation of the electric motor 31 and the switching of the tilting proportional valve 39, in response to detection signal from the potentiometer 23A based on a detected operation amount of the tilt control lever 23. The controller S controls the rotation of the electric motor 31 and the switching of the unit proportional valve 43, in response to detection signal from the potentiometer 45A based on a detected operation amount of the unit control lever 45.

An inverter S1 is electrically connected to the controller S and the power from a battery BT is supplied to the electric motor 31 through the inverter S1. The power generated by the electric motor 31 is stored in the battery BT through the inverter S1.

The operation of the hydraulic control device according to the first embodiment will now be described with reference to FIG. 2.

Figure 2:
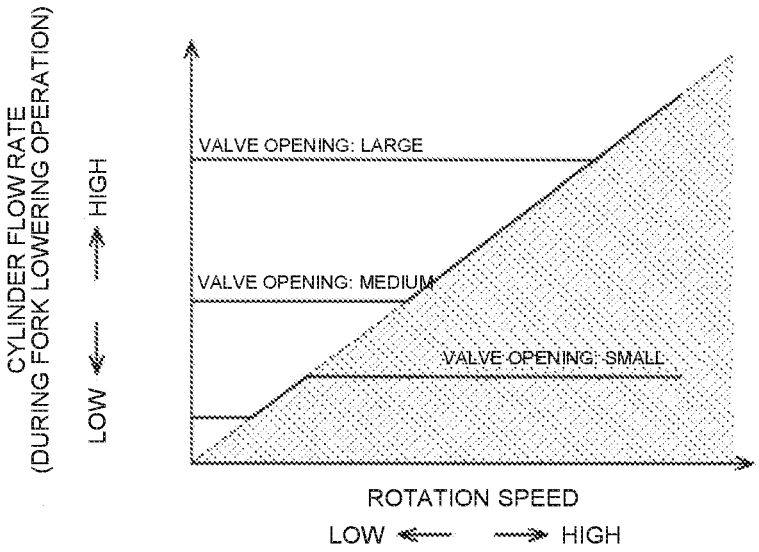
FIG. 2 is a graph showing a relationship among the opening of a valve, the rotation speed of a hydraulic pump and the cylinder flow rate in the flow control device of the embodiment.

Referring to FIG. 2 showing a relationship among the opening of the lowering proportional valve 32, the rotation speed of the hydraulic pump motor 30, and the flow rate of the hydraulic oil that is discharged from the lift cylinder 14 in the hydraulic control device according to the first embodiment, the dotted region corresponds to the flow rate Q1 of the hydraulic oil flowing toward the hydraulic pump motor 30, and the blank region corresponds to the flow rate Q2 at which the hydraulic oil is flowed toward the flow rate control valve 35.

As shown in FIG. 2, in the hydraulic control device according to the first embodiment, the flow rate of the hydraulic oil discharged from the lift cylinder 14 increases with an increase of the opening of the lowering proportional valve 32. The hydraulic oil discharged from the lift cylinder 14 is divided into two ways, namely one flowing at the flow rate Q1 toward the intake port 30A of the hydraulic pump motor 30 and the other flowing at the flow rate Q2 toward the flow rate control valve 35, according to the rotation speed of the hydraulic pump motor 30. Specifically, as shown in FIG. 2, the hydraulic oil that is discharged from the lift cylinder 14 flows at a higher flow rate toward the flow rate control valve 35 with a decrease of the rotation speed of the hydraulic pump motor 30.

The hydraulic pump motor 30 operating at a low rotation speed does not take in sufficient amount of the hydraulic oil from the lift cylinder 14. Therefore, the pressure difference between the pressure P1 and the pressure P2, that is, the difference between the pressures of hydraulic oil before and after passing through the lowering proportional valve 32 is decreased and the opening of the flow rate control valve 35 is increased. As a result, as shown in FIG. 2, the hydraulic oil flows from the lift cylinder 14 at a higher flow rate toward the flow rate control valve 35 with a decrease of the rotation speed of the hydraulic pump motor 30. On the other hand, when the rotation speed of the hydraulic pump motor 30 is increased, the hydraulic pump motor 30 takes in a larger amount of hydraulic oil. Therefore, the pressure difference between the pressure P1 and the pressure P2, that is, the difference between the pressures of hydraulic oil before and after passing through the lowering proportional valve 32 is increased and the opening of the flow rate control valve 35 is decreased. As a result, as shown in FIG. 2, the hydraulic oil flows from the lift cylinder 14 at a higher flow rate toward the hydraulic pump motor 30 with an increase of the rotation speed of the hydraulic pump motor 30.

The flow rates Q1 and Q2 are thus controlled in the hydraulic control device. The following will describe the control performed by the hydraulic control device according to the first embodiment of the present invention when the lowering operation of the forks 16 is performed simultaneously with another operation that is different from the lowering operation of the forks 16, which may be referred herein to as a second operation. It is to be noted that the second operation of the forklift truck 11 according to the first embodiment corresponds to the tilting operation of the mast assembly 13 or to any operation associated with the unit. In the case that the tilting operation of the mast assembly 13 is performed simultaneously with the lowering operation of the forks 16, the second operation is either the forward tilting operation or the rearward tilting operation of the mast assembly 13. In the case that the operation associated with the unit is performed simultaneously with the lowering operation of the forks 16 and if the unit is configured to make a single motion, the single motion or operation corresponds to the second operation, and if the unit is configured to make a plurality of different motions, one of the multiple operations corresponds to the second operation.

The control of the hydraulic control device will now be described with reference to FIGS. 4A to 4C. It is to be noted that the description of the control herein is applicable to any operation that may be performed simultaneously with the lowering operation of the forks 16. Therefore, for the ease of description, the second operation that is performed simultaneously with the lowering operation of the forks 16 will not be specified in the description below.

Figure 4A:
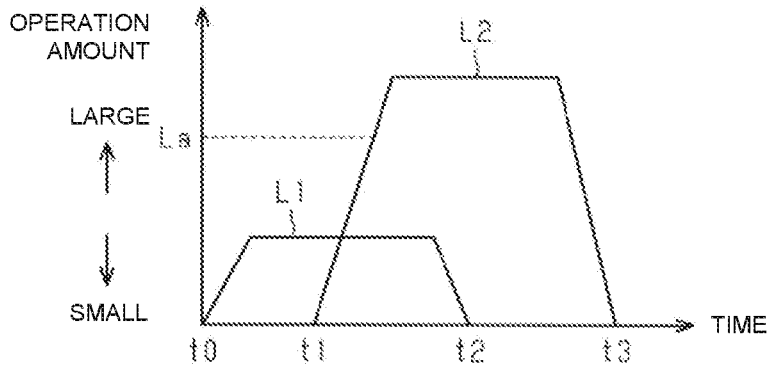
FIG. 4A is a graph showing the operation amount of the control lever in the hydraulic control device according to a first embodiment.

FIG. 4A shows the operation amount of the lift control lever 22 (hereinafter, the lift operation amount) and the operation amount of the control lever that instructs the second operation (hereinafter, the second operation amount). Solid line L1 in FIG. 4A shows the lift operation amount and solid line L2 shows the second operation amount. In the example shown in FIG. 4A, the lowering operation of the forks 16 is performed during a period between time t0 and time t2, and the second operation is performed during a period between time t1 and time t3. As shown in FIG. 4A, the lowering operation of the forks 16 and the second operation are performed simultaneously during a period between the time t1 and the time t2.

Figure 4B:
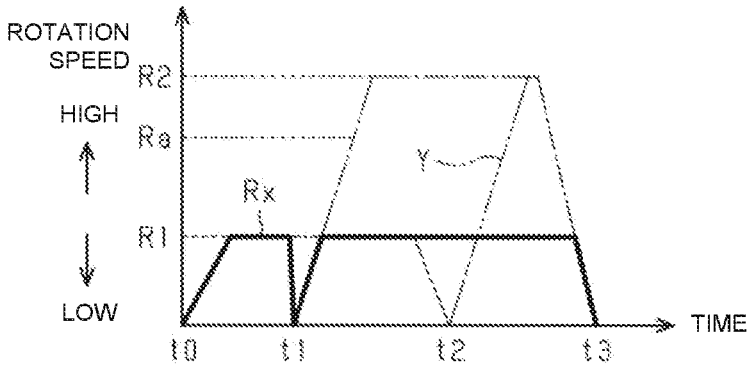
FIG. 4B is a graph showing the rotation speed of the hydraulic pump of in the hydraulic control device according to the first embodiment.
Figure 4C:
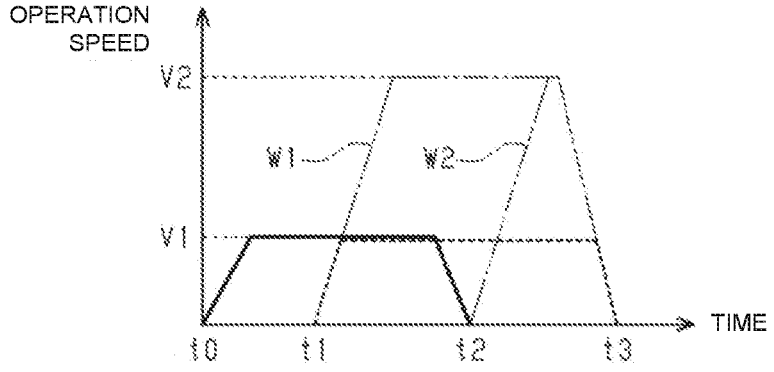
FIG. 4C is a graph showing the operation speed of forks and hydraulically-operated loading unit in the hydraulic control device according to the first embodiment.

FIG. 4B shows the rotation speed of the hydraulic pump motor 30 when the control levers are operated in the manner as indicated in FIG. 4A. R1 in FIG. 4B represents the rotation speed of the hydraulic pump motor 30 that is required for operating the forks 16 at the instruction speed corresponding to the lift operation amount (hereinafter, the required lift operation rotation speed). R2 represents the rotation speed of the hydraulic pump motor 30 that is required for performing the second operation at the instruction speed corresponding to the second operation amount (hereinafter, the required second operation rotation speed). Solid line Rx represents the actual rotation speed of the hydraulic pump motor 30 during the operation of the hydraulic control device according to the first embodiment. In the example shown in FIG. 4B, R2 corresponds to the required second operation rotation speed and R1 corresponds to the required lift operation rotation speed, where R2 is higher than R1.

Under the conditions above, the controller S calculates the required lift operation rotation speed based on the lift operation amount for the period between the time t0 and the time t1 during which the lowering operation of the forks 16 is solely performed and also calculates the opening of the lowering proportional valve 32. Then, the controller S controls the instruction rotation speed of the electric motor 31 so as to operate the hydraulic pump motor 30 at the required lift operation rotation speed. Further, the controller S opens the lowering proportional valve 32 at the first position 32A at the calculated opening. When the lowering operation of the forks 16 is performed solely without the second operation, that is, when the forklift truck is in a single operation mode, the controller S places the lifting proportional valve 37 at the second position 37B, the tilting proportional valve 39 at the first position 39A, and the unit proportional valve 43 at the first position 43A, respectively.

When the lowering proportional valve 32 is opened, the hydraulic oil discharged from the bottom chamber 14B of the lift cylinder 14 flows toward the hydraulic pump motor 30 through the lowering proportional valve 32. When the hydraulic pump motor 30 is driven by the hydraulic oil discharged from the bottom chamber 14B at a rotation speed that is high enough to achieve the instructed speed, the output torque of the electric motor 31 becomes a negative value. Then the electric motor 31 performs a regenerative operation. Specifically, the hydraulic pump motor 30 functions as a hydraulic motor and, accordingly, the electric motor 31 being driven by the hydraulic pump motor 30 functions as a generator. The power thus generated by the electric motor 31 then operating as a generator is stored in the battery BT.

The control lever for the second operation is moved or operated at the time t1 and, accordingly, simultaneous operation in which the lowering operation of the forks 16 and the second operation are performed simultaneously begins. Detecting such operation of the control lever for the second operation, the controller S calculates the required second operation rotation speed based on the second operation amount and then controls the instruction rotation speed of the electric motor 31 so as to operate the hydraulic pump motor 30 at the calculated speed. Specifically, during the simultaneous operation, the controller S causes the hydraulic pump motor 30 to operate at the rotation speed R2 that corresponds to the required second operation rotation speed.

A case will be considered in which the required second operation rotation speed is higher than the required lift operation rotation speed as indicated by dash-dot line in FIG. 4B.

As shown in FIG. 1, the hydraulic control device according to the first embodiment has a single hydraulic pump motor 30. Further, as shown in FIG. 2, providing that the opening of the lowering proportional valve 32 is fixed, the flow rate of the hydraulic oil discharged from the lift cylinder 14 increases with an increase of the rotation speed of the hydraulic pump motor 30. Referring to FIG. 4C, a speed V1 represents a speed of the lowering operation of the forks 16 when the hydraulic pump motor 30 is operated at a rotation speed corresponding to the required lift operation rotation speed during the period between the time t0 and the time t1. The speed V1 rises as indicated by a chain double-dashed line W1 in FIG. 4C, with an increase of the rotation speed of the hydraulic pump motor 30 to a rotation speed corresponding to the required second operation speed. Specifically, with an increase of the operation speed due to an increase in the flow rate of the hydraulic oil discharged from the lift cylinder 14, the lowering operation of the forks 16 is supposed to be performed at the instruction speed (at the speed V1) or higher.

In the case that the lowering operation of the forks 16 and the second operation are performed simultaneously on the conditions described above, the hydraulic control device according to the first embodiment sets the upper limit rotation speed of the hydraulic pump motor 30 so as to restrict an excessive increase in the operation speed of the lowering operation of the forks 16.

According to the first embodiment, the controller S sets the rotation speed R1 shown in FIG. 4B and corresponding to the required lift operation rotation speed as the upper limit rotation speed. The rotation speed R1 corresponds to the required lift operation rotation speed that is required for the lowering operation of the forks 16 at the instruction speed that is based on the lift operation amount at the time when the simultaneous operation mode is started. When the rotation speed of the hydraulic pump motor 30 is higher than the upper limit rotation speed (the rotation speed R1), the controller S controls the instruction rotation speed of the electric motor 31 so as to restrict the operation of the hydraulic pump motor 30. At this time, the instruction rotation speed of the electric motor 31 corresponds to the rotation speed for operating the hydraulic pump motor 30 at the upper limit rotation speed (the rotation speed R1 corresponding to the required lift operation rotation speed). Accordingly, as shown in FIG. 4B, the rotation speed of the hydraulic pump motor 30 is restricted to the rotation speed R1 that corresponds to the required lift operation rotation speed without being increased to the rotation speed R2 that corresponds to the required second operation rotation speed. As a result, as shown in FIG. 4C, the operation speed of the lowering operation of the forks 16 is controlled to the speed V1 during the period between the time t1 and the time t2 during which the lowering operation and the second operation are performed simultaneously. Meanwhile, as indicated by the thick line in FIG. 4C, the operation speed of the second operation is restricted to an operation speed that is lower than the instruction speed (the speed V2 in FIG. 4C) because the rotation speed of the hydraulic pump motor 30 is restricted to the upper limit rotation speed (the rotation speed R1). In other words, the operation speed of the second operation may be an operation speed (the speed V1) according to the upper limit rotation speed.

When the lowering operation of the forks 16 is finished at the time t2, that is, by returning the lift control lever 22 to the neutral position, the second operation may be performed solely in the single operation mode. It is supposed that in this case the controller S controls the operation of the hydraulic pump motor 30 at the required second operation rotation speed so as to achieve the instruction speed of the second operation, without controlling the hydraulic pump motor 30 to prevent the hydraulic pump motor 30 from operating beyond the upper limit operation speed. In this case, the operation speed of the second operation is supposed to increase as indicated by a chain double-dashed line W2 in FIG. 4C with an increase of the rotation speed of the hydraulic pump motor 30 after the time t2 as indicated by the chain double-dashed line Y in FIG. 4B.

Even after the operation is changed from the simultaneous operation mode in which the lowering operation of the forks 16 and the second operation are performed simultaneously to the single operation mode in which the second operation is solely performed, the hydraulic control device according to the first embodiment continues the restriction of the rotation speed of the hydraulic pump motor 30 for the upper limit rotation speed that is used in the afore-mentioned simultaneous operation mode in which two operations are performed simultaneously. Specifically, the controller S continues the restriction of the rotation speed of the hydraulic pump motor 30 during the period between the time t2 and the time t3 at which the second operation is finished. Therefore, the rotation speed of the hydraulic pump motor 30 is maintained at the upper limit rotation speed (or the rotation speed R1) after the time t2, as shown in FIG. 4B, with the result that the operation speed of the second operation may be at the speed V1 that corresponds to the upper limit rotation speed.

It is to be noted that the upper limit rotation speed according to the first embodiment corresponds to the required lift operation rotation speed, so that the upper limit rotation speed increases to a rotation speed Ra in FIG. 4B, for example, with an increase of the lift operation amount to La in FIG. 4A. Specifically, as the lift operation amount is increased from the example of FIG. 4A, the operation speed of the second operation that is performed simultaneously with the lowering operation of the forks 16 is increased, approaching the speed V2.

In the first embodiment, the upper limit rotation speed varies according to the instruction speed of the lowering operation of the forks 16 based on the lift operation amount. Such variation of the upper limit rotation speed remains valid when the instruction speed of the lowering operation of the forks 16 increases in accordance with the increase in the lift operation amount during the simultaneous operation of the lowering operation of the forks 16 and the second operation. Therefore, when the lift operation amount is increased during the simultaneous operation mode, the operation speed of the lowering operation of the forks 16 increases, and the operation speed of the second operation also increases with an increase in the upper limit rotation speed. Specifically, during the simultaneous operation mode, when the required lift operation rotation speed exceeds the upper limit rotation speed that is set at the start of the simultaneous operation mode in which the two operations are simultaneously performed in response to the increase in the lift operation amount, then the upper limit rotation speed is changed to a higher rotation speed in accordance with the increase of the required lift operation rotation speed.

It is to be noted that, in the case that the required lift operation rotation speed is higher than the required second operation rotation speed, the flow rate control valve 35 of the hydraulic control device according to the first embodiment achieves the operation speed of the lowering operation of the forks 16. As described above, the hydraulic control device according to the first embodiment determines the rotation speed of the hydraulic pump motor 30 as the required second operation rotation speed, so that when the required second operation rotation speed is low, the hydraulic oil discharged from the lift cylinder 14 is hard to be taken into the hydraulic pump motor 30. In such case, however, the pressure difference between the pressure P1 and the pressure P2, that is, the difference between the pressures before and after passing through the lowering proportional valve 32, respectively, is decreased and, accordingly, the opening of the flow rate control valve 35 is increased. As a result, the hydraulic oil discharged from the lift cylinder 14 is allowed to flow through the drain passage (or the pipe K2) shown in FIG. 3, and the operation speed of the lowering operation of the forks 16 is achieved.

In the hydraulic control device according to the first embodiment, in the case that the required lift operation rotation speed, which may be the upper limit rotation speed, is the required second operation rotation speed or higher, that is, in the case that the required second operation rotation speed is the required lift operation rotation speed or lower, the controller S does not restrict the rotation speed of the hydraulic pump motor 30 by the upper limit rotation speed. Specifically, in the above case, the controller S controls the instruction rotation speed of the electric motor 31 so as to operate the hydraulic pump motor 30 at the required second operation rotation speed.

The first embodiment of the present invention offers the following effects.

(1) In the case that the lowering operation of the forks 16 and the second operation are performed simultaneously, an abrupt change of the operation speed of the lowering operation of the forks 16 may be prevented by restricting the rotation speed of the hydraulic pump motor 30 to the upper limit rotation speed. On the other hand, although the operation speed of the second operation becomes lower with respect to the instruction speed, the change of the operation speed of the second operation may be made smaller. Therefore, a plurality of operations of a forklift truck may be performed successfully.

(2) According to the first embodiment, by setting the upper limit rotation speed to a rotation speed corresponding to the required lift operation rotation speed, the lowering operation of the forks 16 is performed without irregular variation in the operation speed during switching of the operation from the single operation mode of the second operation to the simultaneous operation mode.

(3) Because the rotation speed of the hydraulic pump motor 30 is restricted to the upper limit rotation speed, no abrupt change occurs in the operation speed during switching of the operation from the simultaneous operation mode to the single operation mode of the second operation.

(4) By setting the upper limit rotation speed to a rotation speed corresponding to the required lift operation rotation speed, the upper limit rotation speed may be changed in accordance with the change in the lift operation amount. Specifically, by changing the upper limit rotation speed, the operation speed of the lowering operation of the forks 16 may be increased in accordance with the increasing instruction speed, and the operation speed of the second operation may be increased, accordingly. As a result, a plurality of loading operations is operated in a preferred manner.

Second Embodiment

A hydraulic control device of a forklift truck according to a second embodiment of the present invention will now be described with reference to FIGS. 5A to 5C. In the following description, the configuration and the control that have already been mentioned in the description of the first embodiment will be simplified or not be reiterated.

The second embodiment is different from the first embodiment in the rotation speed set as the upper limit rotation speed that restricts the rotation speed of the hydraulic pump motor 30, but the first and second embodiments are substantially the same in other respects including the control.

Figure 5A:
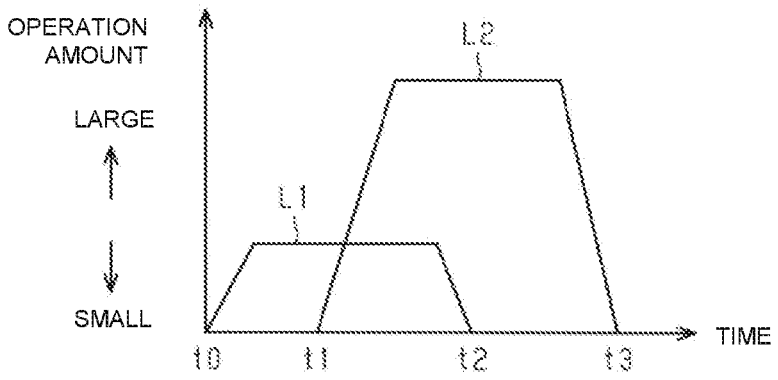
FIG. 5A is a graph showing the operation amount of the control levers in the hydraulic control device according to a second embodiment of the present invention.
Figure 5B:
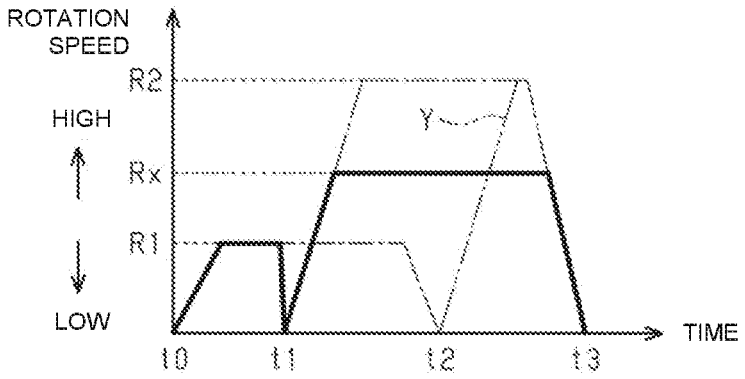
FIG. 5B is a graph showing the rotation speed of a hydraulic pump in the hydraulic control device according to the second embodiment.
Figure 5C:
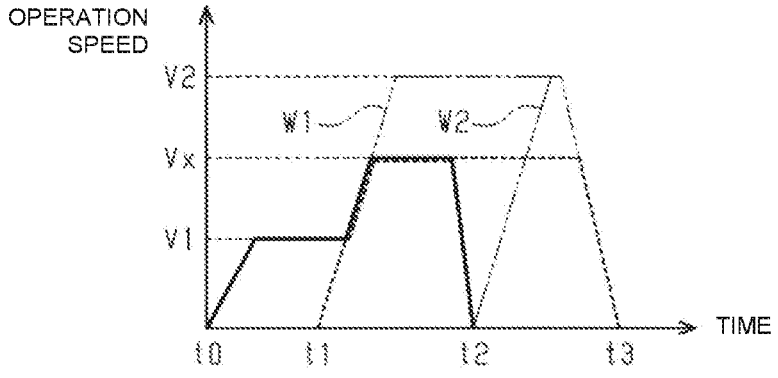
FIG. 5C is a graph showing the operation speed of forks and hydraulically-operated loading unit in the hydraulic control device according to the second embodiment.

FIG. 5A is similar to FIG. 4A and shows the lift operation amount and the second operation amount. FIG. 5B is similar to FIG. 4B and shows the rotation speed of the hydraulic pump motor 30 when the control levers are operated. A rotation speed R1 corresponds to the required lift operation rotation speed and a rotation speed R2 corresponds to the required second operation rotation speed of the hydraulic pump motor 30, respectively. A rotation speed Rx is the actual rotation speed of the hydraulic pump motor 30 when the lowering operation of the forks 16 and the second operation are performed simultaneously by the hydraulic control device.

The upper limit rotation speed according to the second embodiment is set at the rotation speed Rx that is lower than the rotation speed required for operating the hydraulic part of the forklift truck 11 (e.g. the mast assembly 13 and the unit) at the highest instruction speed that is based on the operation of the control lever for the second operation. It is to be noted that the upper limit rotation speed according to the second embodiment is fixed.

When the lowering operation of the forks 16 and the second operation are performed simultaneously at the time t1, the controller S calculates the required second operation rotation speed based on the second operation amount. The controller S then controls the instruction rotation speed of the electric motor 31 so as to operate the hydraulic pump motor 30 at the calculated required second operation rotation speed. Specifically, in the simultaneous operation of the lowering operation and the second operation, the controller S causes the hydraulic pump motor 30 to operate at the rotation speed R2 corresponding to the required second operation rotation speed.

Subsequently, in the state where the required second operation rotation speed is higher than the required lift operation rotation speed, the controller S determines whether or not the required lift operation rotation speed is higher than the rotation speed Rx that corresponds to the upper limit rotation speed. When the required lift operation rotation speed is lower than the rotation speed Rx, then the controller S restricts the operation of the hydraulic pump motor 30. When the required second operation rotation speed that corresponds to the required rotation speed of the hydraulic pump motor 30 is higher than the upper limit rotation speed (or the rotation speed Rx), then the controller S restricts the rotation speed of the hydraulic pump motor 30 to the upper limit rotation speed. In response to the control, the rotation speed of the hydraulic pump motor 30 is restricted to the rotation speed Rx that corresponds to the upper limit rotation speed, as shown in FIG. 5B, without being raised to the rotation speed R2 corresponding to the required second operation rotation speed. As a result, as shown in FIG. 5C, the operation speed of the lowering operation of the forks 16 is controlled to the speed Vx in the period between t1 and t2 during which the lowering operation of the forks 16 and the second operation are performed simultaneously. The speed Vx is higher than the speed V1 that corresponds to the required lift operation rotation speed but lower than the speed V2 that corresponds to the required second operation rotation speed. Meanwhile, by restricting the rotation speed of the hydraulic pump motor 30 to the upper limit rotation speed (the rotation speed Rx), the hydraulic pump motor 30 for the operation speed of the second operation is restricted to the operation speed that is lower than the instruction speed (the speed V2 in FIG. 5C) as indicated by the thick dotted line in FIG. 5C. However, the operation speed of the second operation is higher than the speed V1 that corresponds to the instruction speed for the lowering operation of the forks 16 and approximate to the speed V2 that corresponds to the instruction speed for the second operation.

As in the case of the first embodiment, even after the operation is changed from the simultaneous operation mode in which the lowering operation of the forks 16 and the second operation are performed simultaneously to the single operation mode in which the second operation is solely performed, the controller S continues the restriction of the rotation speed of the hydraulic pump motor 30 to the upper limit rotation speed that is used in the afore-mentioned simultaneous operation mode. Specifically, the controller S continues the restriction of the rotation speed of the hydraulic pump motor 30 during the period between the time t2 and the time t3 at which the second operation is finished. As shown in FIG. 5B, the rotation speed of the hydraulic pump motor 30 is maintained at the upper limit rotation speed (the rotation speed Rx) after the time t2 and, therefore, the operation speed of the second operation may be the speed Vx corresponding to the upper limit rotation speed.

It is to be noted that the upper limit rotation speed according to the second embodiment is a fixed rotation speed, so that, when the required lift operation rotation speed is higher than the rotation speed Rx which is the upper limit rotation speed, the controller S does not restrict the instruction rotation speed of the electric motor 31 with the upper limit rotation speed. This is because, if the instruction rotation speed is restricted when the required lift operation rotation speed is higher than the upper limit rotation seed, the operation speed of the lowering operation of the forks 16 will also be decreased. Therefore, when the required lift operation rotation speed is higher than the upper limit rotation speed, the controller S controls the instruction rotation speed of the electric motor 31 so that the rotation speed of the hydraulic pump motor 30 becomes the required second operation rotation speed (the rotation speed R2 in FIG. 5B). Further, according to the second embodiment, when the upper limit rotation speed is higher than the required second operation rotation speed, that is, when the required second operation rotation speed is the upper limit rotation speed or lower, the controller S does not restrict the rotation speed of the hydraulic pump motor 30 with the upper limit rotation speed. Specifically, in the above case, the controller S controls the instruction rotation speed of the electric motor 31 so as to operate the hydraulic pump motor 30 at the required second operation rotation speed.

It is to be noted that the upper limit rotation speed according to the second embodiment may be determined based on one specific second operation of plural second operations. For example, the specific second operation may be the tilting operation of the mast assembly 13. Alternatively, the upper limit rotation speed according to the second embodiment may be determined individually for each different second operation. In this case, the controller S sets the upper limit rotation speed for each of the second operations that are performed simultaneously with the lowering operation of the forks 16. In the case that the lowering operation of the forks 16 and any two or more second operations are performed simultaneously, the controller S may designate the upper limit rotation speed according to any one selected second operation. For example, the selected one of the second operations may be the second operation the required rotation speed of which is the highest.

According to the second embodiment, by restricting the rotation speed of the hydraulic pump motor 30 to the upper limit rotation speed, as described earlier, the operation speed of the lowering operation of the forks 16 becomes higher than the instructed speed. Therefore, it is preferable that the upper limit rotation speed should be set only to such an extent that causes no abrupt change in the operation speed and such speed may be found through simulations or the like.

The second embodiment offers the following effects in addition to the effect described under (1) with reference to the first embodiment.

(5) When the loading operation of the forklift truck is changed from the simultaneous operation mode in which the lowering operation of the forks 16 and the second operation are simultaneously performed to the single operation mode in which the second operation is solely performed, the rotation speed of the hydraulic pump motor 30 is restricted to the upper limit rotation speed and, therefore, the operation speed of the second operation is prevented from being changed abruptly.

(6) When the required lift operation rotation speed that is the upper limit rotation speed or higher, the operation speeds of the respective operations are not restricted, so that the operations may be performed smoothly. It is to be noted that the above first and second embodiments may variously be modified as described below.

In the above embodiments, the rotation speed of the hydraulic pump motor 30 may not be restricted when the lift operation amount is small. In this case, the controller S controls the instruction rotation speed of the electric motor 31 so as to operate the hydraulic pump motor 30 at the required second operation rotation speed, so that the second operation is performed at the instruction speed that is required by the second operation amount. When the lift operation amount is small, the required lift operation rotation speed is small and the opening of the lowering proportional valve 32 is also small. As shown in FIG. 2, when the opening of the lowering proportional valve 32 is small, the hydraulic oil that is required for the second operation is taken in by the hydraulic pump motor 30 from the oil tank 34, without being influenced by the rotation speed of the hydraulic pump motor 30. In other words, the hydraulic oil discharged from the lift cylinder 14 is not taken in easily by the hydraulic pump motor 30. When the opening of the lowering proportional valve 32 is small, the operation speed of the lowering operation of the forks 16 is not affected significantly by the operation of the hydraulic pump motor 30 at the required operation speed of the second operation and therefore, no abrupt change occurs in the operation speed of the lowering operation of the forks 16. The aforementioned small opening of the lowering proportional valve 32 refers to the opening of the lowering proportional valve 32 of, for example, about 30% of the fully opened state, at which the hydraulic pump motor 30 cannot take in the hydraulic oil on the lift cylinder 14 side. The opening of the lowering proportional valve 32 that may be the reference for determining whether or not the restriction should be performed by the upper limit rotation speed, is considered to vary according to the capacity of the hydraulic pump motor 30 and the structure of the lowering proportional valve 32 (e.g. the diameter of the lowering proportional valve 32 as measured at full open). Therefore, it is preferable that the opening of the lowering proportional valve 32 should be set through simulations or the like, taking such factors into consideration. According to the configuration, it is possible that various loading operations may be accomplished without restricting their operation speed.

In the above embodiments, the hydraulic control device may be adapted to control the lifting and lowering operation of the forks 16 and the tilting operation of the mast assembly 13. According to such hydraulic control device, in the case that the lowering operation of the forks 16 and at least one of the frontward tilting operation or the rearward tilting operation are performed simultaneously, the hydraulic control device restricts the rotation speed of the hydraulic pump motor 30 to the upper limit rotation speed.

In the above embodiments, the hydraulic control device may be a hydraulic control device of a forklift truck that includes a plurality of units and a hydraulic mechanism (a hydraulic cylinder) that drives the plural units.

In the above embodiments, the hydraulic control device may be adapted for use in a forklift truck that has a hydraulic power steering mechanism as the hydraulic mechanism. The hydraulic power steering mechanism has an independent hydraulic cylinder that drives the steering device that is a separate hydraulically-operated unit other than the forks 16.

In the above embodiments, in the case that two or more second operations are performed simultaneously with the lowering operation of the forks 16, the required rotation speed of the hydraulic pump motor 30 may be calculated in the following manner. The controller S calculates the required speeds of the hydraulic pump motor 30 for the respective second operations. The controller S controls the instruction rotation speed of the electric motor 31 so as to operate the hydraulic pump motor 30 at the rotation speed that is the highest of the calculated required rotation speeds for the second operations. The controller S also restricts the rotation speed of the hydraulic pump motor 30 to the upper limit rotation speed as in the case of the first and second embodiments. This configuration enables a system in which, when two or more second operations are performed simultaneously with the lowering operation of the forks 16, the variation in the operation speed not only of the lowering operation but also of the operation speeds of the second operations are made smaller. In the modified embodiment, if the mast assembly 13 and a unit are operated simultaneously with the lowering operation of the forks 16, the tilt cylinders 19 that drive the mast assembly 13 and the unit hydraulic cylinders 25 that drive the unit correspond to the plurality of hydraulic cylinders of the present invention. The mast assembly 13 and the unit correspond to the plurality of hydraulically-operated units of the present invention. The instruction members that instruct the operation of the mast assembly 13 and the unit correspond to the plurality of instruction members. The second operation includes but not limited to the aforementioned second operations of the mast assembly 13 and the unit. For example, the steering operation of the hydraulic power steering mechanism in the modified embodiment may be the second operation. In the case that the unit handles a plurality of operations and such operations are individually controlled by separate hydraulic cylinders, each of the operations of the unit may be the second operation.

According to the present invention, the instruction members that instruct lifting operation of the forks 16, tilting operation of the mast assembly 13, and operation of the unit may not necessarily be of a lever type, but it includes any other type of instruction member, such as a pushbutton switch.

According to the present invention, the control valves such as the tilting proportional valve 39 and the unit proportional valve 43 may not necessarily be of a solenoid type, and mechanical or hydraulic valves may also be used.

According to the present invention, the control valves such as the lowering proportional valve 32 and the lifting proportional valve 37 may not necessarily be of a solenoid type, and mechanical or hydraulic valves may also be used.

Figure 6:
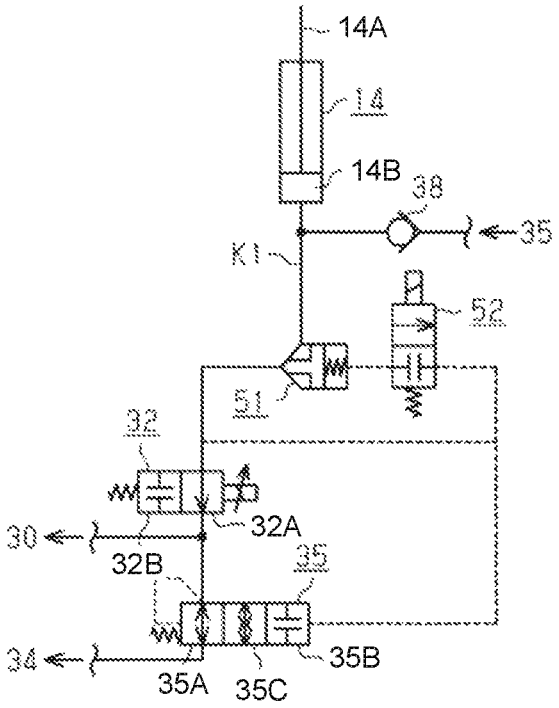
FIG. 6 is a circuit diagram showing a part of a hydraulic control device according to another embodiment of the present invention.

According to the above embodiments, the hydraulic control device has a mechanism that allows the flow of hydraulic oil from the lift cylinder 14 toward the hydraulic pump motor 30 during the lowering operation of the forks 16 but blocks the flow of hydraulic oil from the lift cylinder 14 toward the hydraulic pump motor 30 during the lifting operation of the forks 16 or when the operation of the forks 16 is at a stop. According to the present invention, however, the mechanism may be modified, for example, as shown in FIG. 6. The mechanism of FIG. 6 includes a poppet valve 51 and a solenoid valve 52 in addition to the lowering proportional valve 32. In the lowering operation of the forks 16, the poppet valve 51 and the solenoid valve 52 are both opened and the flow rate of the hydraulic oil flowing toward the hydraulic pump motor 30 is controlled by the opening of the lowering proportional valve 32. The flow rate control valve 35 is opened in accordance with the difference in the pressure between the pressure in the pipe between the lift cylinder 14 and the lowering proportional valve 32 and the pressure in the pipe between the lowering proportional valve 32 and the hydraulic pump motor 30.

According to the present invention, the flow rate control valve 35 of the hydraulic control device may be of a type.

The hydraulic control device according to the present invention may be adapted for use in a battery-powered forklift truck. Alternatively, the hydraulic control device of the present invention may be adapted for use in an engine-driven forklift truck or a hybrid forklift truck.

What is claimed is:

1. A hydraulic control device of a forklift truck comprising:

a first hydraulic cylinder that lifts and lowers forks of the forklift truck;

a first instruction member that instructs lifting and lowering operation of the forks;

a second hydraulic cylinder that operates a hydraulically-operated unit other than the forks;

a second instruction member that instructs operation of the hydraulically-operated unit;

a hydraulic pump that supplies hydraulic oil to the first hydraulic cylinder and the second hydraulic cylinder;

an electric motor that is connected to the hydraulic pump and causes the hydraulic pump to operate;

a first passage through which the first hydraulic cylinder and an intake port of the hydraulic pump are connected to each other;

a lowering control valve that is disposed in the first passage and allows flow of hydraulic oil from the first hydraulic cylinder toward the hydraulic pump while the forks are being lowered and that blocks the flow of hydraulic oil from the first hydraulic cylinder toward the hydraulic pump while the forks are being lifted or at a stop;

a drain passage that is branched from the first passage at a portion between the lowering control valve and the hydraulic pump;

a flow rate control valve that is disposed in the drain passage and controls a flow rate of hydraulic oil; and a controller that controls the electric motor based on an operation of the first instruction member and an operation of the second instruction member, wherein in a case of a simultaneous operation mode in which a lowering operation of the forks and an operation of the hydraulically-operated unit are performed simultaneously, when a required rotation speed of the hydraulic pump required for operating the hydraulically-operated unit at an instruction speed based on the operation of the second instruction member is a specified rotation speed or lower, the controller controls an instruction rotation speed of the electric motor so as to operate the hydraulic pump at the required rotation speed, and when the required rotation speed of the hydraulic pump is higher than the specified rotation speed, the controller controls the instruction rotation speed of the electric motor so as to operate the hydraulic pump at the specified rotation speed to thereby restrict the operation of the hydraulic pump.

2. The hydraulic control device of the forklift truck according to claim 1, wherein, during a period between a time at which the simultaneous operation mode is changed to a single operation mode in which the operation of the hydraulically-operated unit is solely performed and a time at which the operation of the second instruction member is finished, when the required rotation speed of the hydraulic pump that is required for operating the hydraulically-operated unit at the instruction speed based on the operation of the second instruction member is the specified rotation speed or lower, the controller controls the instruction rotation speed of the electric motor to thereby operate the hydraulic pump at the required rotation speed, and when the required rotation speed is higher than the specified rotation speed, the controller controls the instruction rotation speed of the electric motor to thereby operate the hydraulic pump at the specified rotation speed.

3. The hydraulic control device of the forklift truck according to claim 1, wherein in the case of the simultaneous operation mode, the controller sets, as the specified rotation speed, the required rotation speed of the hydraulic pump that is required for the lowering operation of the forks at the instruction speed based on the operation of the first instruction member at a time when the simultaneous operation mode is started.

4. The hydraulic control device of the forklift truck according to claim 3, wherein when, in response to an increase of the instruction speed based on the operation of the first instruction member, the required rotation speed of the hydraulic pump required for the lowering operation of the forks at the instruction speed exceeds the specified rotation speed that is set at the time when the simultaneous operation mode is started, the controller changes the specified rotation speed to the required rotation speed.

5. The hydraulic control device of the forklift truck according to claim 1, wherein the specified rotation speed is a fixed rotation speed that is lower than the required rotation speed of the hydraulic pump that is required for operating the hydraulically-operated unit at a highest instruction speed based on the operation of the second instruction member, and in the case of the simultaneous operation mode, when the required rotation speed of the hydraulic pump that is required for the lowering operation of the forks at the instruction speed based on the operation of the first instruction member at a time when the simultaneous operation mode is started is higher than the fixed rotation speed, the controller controls the instruction rotation speed of the electric motor so as to operate the hydraulic pump at the required rotation speed that is required for operating the hydraulically-operated unit at the instruction speed based on the operation of the second instruction member.

6. The hydraulic control device of the forklift truck according to claim 1, wherein the lowering control valve is a proportional valve whose opening is variable, and when the operation amount of the first instruction member is smaller than a specified operation amount, the controller controls the instruction rotation speed of the electric motor so as to operate the hydraulic pump at the required rotation speed that is required for operating the hydraulically-operated unit at the instruction speed based on the operation of the second instruction member.

7. The hydraulic control device of the forklift truck according to claim 1, comprising:

a plurality of the hydraulically-operated unit;

a plurality of the second hydraulic cylinder which operates the respective hydraulically-operated units; and a plurality of the second instruction member which instructs operation of the respective hydraulically-operated unit, wherein in a case of an operation mode in which two or more of the hydraulically-operated units are operated simultaneously with the lowering operation of the forks, the controller calculates required rotation speeds of the hydraulic pump required for operating the respective two or more hydraulically-operated units at their respective instruction speeds based on operations of their respective second instruction members, and controls the instruction rotation speed of the electric motor so as to operate the hydraulic pump at the required rotation speed which is the highest of the calculated required rotation speeds.

* * * * *